US006045178A

United States Patent [19]

Miller

[11] Patent Number: 6,045,178

[45] Date of Patent: Apr. 4, 2000

[54] OUTDOORSMAN'S SUPPORT OR CHAIR

[75] Inventor: Richmond Marlin Miller, Bloomsburg, Pa.

[73] Assignee: Istari, Inc., Bloomsburg, Pa.

[21] Appl. No.: 09/182,595

[22] Filed: Oct. 30, 1998

[51] Int. Cl.[7] ..... A47C 13/00

[52] U.S. Cl. ..... 297/129; 297/188.01; 297/452.17; 5/632; 5/694; 5/702; 5/656; 5/655.4

[58] Field of Search ..... 297/4, 129, 92, 297/93, 188.01, 188.04, 188.07, 188.13, 188.2, 283.1, 283.2, 423.1, 451.13, 452.17, 452.41; 5/630, 632, 420, 694, 702, 703, 656, 655.4, 699, 911; 224/155, 156, 579.58

[56] References Cited

U.S. PATENT DOCUMENTS

| | | | |
|---|---|---|---|
| 41,870 | 3/1864 | Sus | 224/155 |
| D. 356,692 | 3/1995 | Dawson | D6/347 |
| D. 374,127 | 10/1996 | Diaz | D6/358 |
| 3,700,278 | 10/1972 | Gulba | 297/191 |
| 3,899,210 | 8/1975 | Samhammer et al. | 297/445 |
| 4,011,611 | 3/1977 | Lederman | 297/452.17 X |
| 4,179,158 | 12/1979 | Flaum et al. | 297/118 |
| 4,190,918 | 3/1980 | Harvell | 5/465 |
| 4,281,873 | 8/1981 | Holland | 297/452.17 X |
| 4,597,605 | 7/1986 | Gilbert | 297/219 |
| 4,854,637 | 8/1989 | McCree | 297/188 |
| 4,925,064 | 5/1990 | Comora | 297/4 X |
| 5,350,215 | 9/1994 | DeMars | 297/194 |
| 5,481,767 | 1/1996 | Lewis | 224/156 X |
| 5,524,956 | 6/1996 | Moore | 297/4 |
| 5,588,570 | 12/1996 | Zirbel | 297/129 X |
| 5,607,089 | 3/1997 | Strum | 224/155 |
| 5,620,227 | 4/1997 | Brune | 297/4 |
| 5,641,199 | 6/1997 | Bond-madsen | 297/129 X |
| 5,695,099 | 12/1997 | Strum | 224/155 |
| 5,839,783 | 11/1998 | Black | 297/4 X |

*Primary Examiner*—Laurie K. Cranmer
*Attorney, Agent, or Firm*—Michael F. Petock, Esq.

[57] ABSTRACT

An outdoorsman's support or chair is comprised of a substantially filled flexible container provided with shoulder straps for easy transport. The flexible container is filled with pellets and is preferably waterproof. It is adaptable to conform to the shape of a person providing comfortable support and insulation from the environment. The flexible container may be provided with a plurality of other straps which may be utilized for attaching other objects or gear to it during transport and for mounting the chair to various other structures, such as the trunk and limbs of trees. The chair is comprised of a spherical structure at one end and an elongated portion at a second end. The elongated portion at the second end may be folded over and juxtaposed to the spherical structure and secured by a folding strap for ease in transport. The flexible container may be used in various positions, including that of a seat with a back support, a seat without any back support, and for support in a prone or supine position wherein the upper torso of the person may be supported on the spherical structure end. The chair may be provided with an internal pocket for storing various items such as food and other supplies. The flexible container may be provided with a plurality of colors to provide a camouflage effect. Footstraps may be provided, preferably mounted to the spherical structure end.

16 Claims, 4 Drawing Sheets

OUTDOORSMAN'S SUPPORT OR CHAIR

FIELD OF THE INVENTION

The present invention relates to an outdoorsman's support or chair. More particularity, the present invention relates to a chair which is adapted to conform to a shape adapted to comfortably support an outdoorsman. More particularly, the present invention relates to an outdoorsman's chair which is comfortable, easily portable, which provides insulation and can be easily secured in various locations, including mounting in a tree or the like.

BACKGROUND OF THE INVENTION

There is a need for an easily portable, comfortable chair which provides support for sportsmen and other outdoorsmen such as hunters and the like. Various efforts have been made to construct chairs which are usable by hunters and other outdoor sportsmen. For example, Dawson discloses a hunter's chair in Design Patent No. 356,692 wherein the rigid frame of the chair may be hung from another fixture. Strum discloses a sportsman backpack which includes a rigid structure which may be used as a chair in U.S. Pat. Nos. 5,607,089 and 5,695,099. Gulba discloses a portable seating apparatus which may be attached between upright trees. However, all of these structures have deficiencies, limited use and structures which do not provide the advantages of the present invention.

SUMMARY OF THE INVENTION

One of the advantages of the present invention is that it provides a flexible and adaptable support or chair which is comfortable, which supports the person and adapts to a certain degree to the shape of the person providing comfortable support and insulation helping to maintain body heat.

Another advantage of the present invention is that it is provided with shoulder straps which enable easy transport of the chair to an outdoor or wilderness location.

Another advantage of the present invention is that its flexible container, which is filled with particles, adapts to the shape of the person and to the shape of the structure on which it may be mounted, whether it be the ground, a plurality of tree limbs or other supporting structure.

Another advantage of the present invention is that the flexible chair may be readily folded into a compact structure and maintained in that form by a folding strap.

Another advantage of the present invention is that it is provided with straps for carrying gear or other items.

Another advantage of the present invention is that it is provided with straps for securing to other objects, such as a tree trunk and limbs.

Another advantage of the present invention is that the outside cover may be provided with various selected colors to provide a camouflage effect.

Another advantage of the present invention is that it is easy to carry or transport.

Another advantage of the present invention is that it is comfortable, and enables comfortable support for extended periods of time where a hunter or other outdoorsman may remain motionless for extended periods of time.

Another advantage of the present invention is that it provides an insulation capability between the person and the environment, such as the ground.

Another advantage of the present invention is that it is waterproof.

Another advantage of the present invention is that it is lightweight and easily transportable.

Another advantage of the present invention is that it may be used as a gun rest.

Briefly and basically, in accordance with the present invention, a portable support for a person for use in an outdoor setting is provided which comprises a flexible container. The flexible container is at least partially filled with particles. The flexible container is adapted to conform to a shape adapted to support a person in a seated or other position, such as a prone position. Straps are attached to the flexible container with the straps being adapted for mounting over a person's shoulder.

Other aspects of the present invention include the fact that the flexible container is shaped and adapted to form a substantially spherical structure at a first end and an elongated portion at a second end. The elongated portion at the second end may be folded over and juxtaposed the spherical structure and secured by a folding strap.

The portable support or chair may also include a sealable pocket mounted within the flexible container for storing various items, including food and other supplies which may be useful to the outdoorsman or sportsman.

The portable supporting chair may also include one or more additional pairs of straps which may be releasably connected together for mounting additional objects such as gear to the flexible container when being transported by a person and for securing the flexible container in position when utilized to support a person, such as securing the chair to a tree trunk, tree limbs or other supporting structure.

In accordance with the present invention, a plurality of supporting members may be secured to the inner surface of the flexible container for reinforcing the flexible container during use. The portable chair may also include a pair of foot straps mounted to the flexible container which provide additional comfort to the sportsman. These may preferably be mounted to the spherical structure of the flexible container. The flexible container may also have mounted thereon sealable packets for securing ammunition or other items in a readily accessible manner.

The elongated portion of the flexible container may be utilized as a back support when the person is seated on the spherical structure. The flexible container may be stretched out such that the elongated portion extends from the spherical structure and lays along the ground such that a person may be supported in a prone or supine position where the upper torso of a person may be juxtaposed with the spherical structure.

In a preferred embodiment, the flexible container is comprised of a waterproof material.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
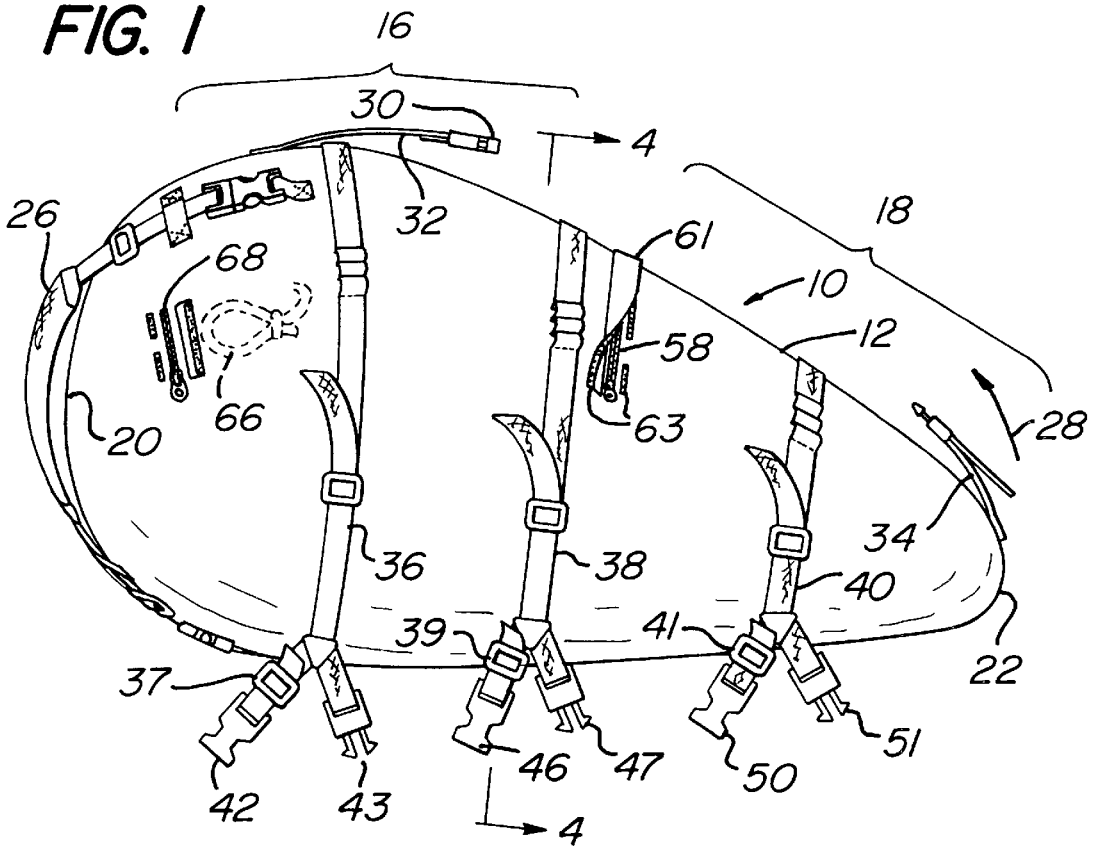
FIG. 1 is a side elevation view of a portable support for a person for use in an outdoor setting in accordance with the present invention.

Referring now to the drawings, wherein like numerals indicate like elements, there is shown in FIGS. 1 though 4 an outdoorsman's support or chair 10. Although, for purposes of description, this may be referred to as an outdoor chair. It is understood that the structure disclosed herein may be utilized to provide various forms of support for hunters or other persons participating in outdoor sports, particularly where the person may be required to or desires to remain in a relatively motionless condition for an extended period of time. This is particularly the case where the ambient outdoor temperature may be less than ideal, such as encountered by hunters during the fall and winter hunting seasons.

Figure 4:
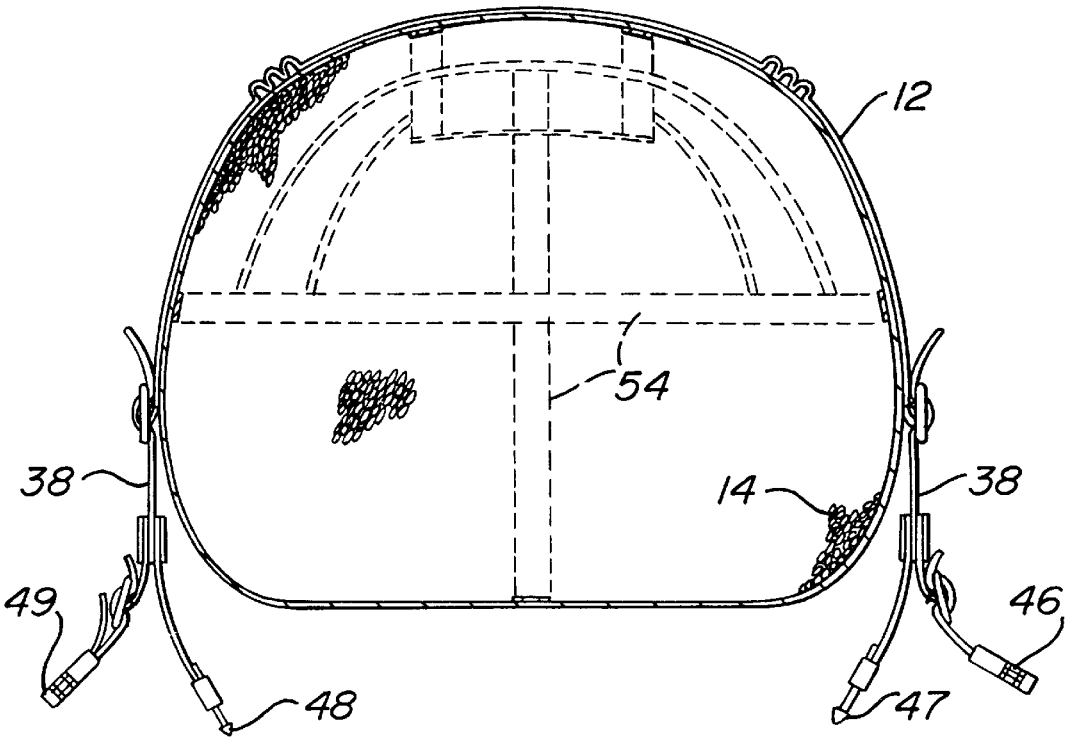
FIG. 4 is a cross sectional view taken along line 4—4 FIG. 1.
Figure 5:
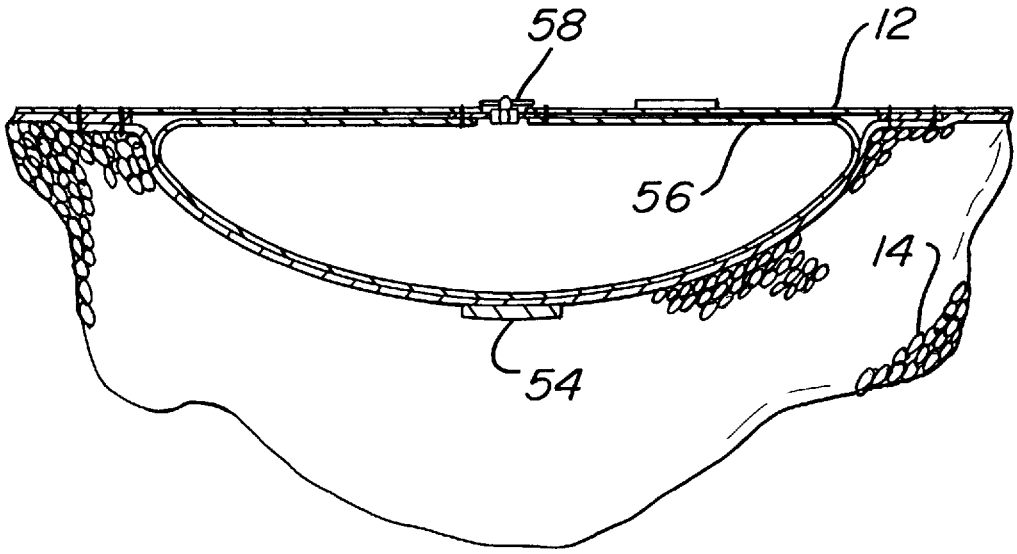
FIG. 5 is a broken away cross sectional view of the mounting of a sealable pocket mounted within said flexible container.

The outdoor chair 10 is comprised of a flexible container 12 which may be filled, or at least partially filled, with particles 14, such as polystyrene pellets. The flexible container may be made of any suitable material, such as various cloths, plastics materials, canvas, nylon or the like. It is preferred that the flexible container material be waterproof such that the outdoor chair 10 may be utilized in inclement conditions, such as conditions of rain or snow, or for use on damp or wet ground or the like. The particles may be made of any suitable material so long as they are in the form of particles or pellets which will enable the flexible container to adapt to various shapes, including the shape of the person being supported as well as the shape of the environment supporting the flexible container, whether it be the ground, the trunk of a tree, branches of the tree or the like. The particles are best illustrated in FIGS. 4 and 5, where they are broken away to show the other internal structures.

The flexible container is preferably constructed such that it is provided with a substantially spherical structure 16 at one end and an substantially elongated portion 18 at a second end. It is understood that spherical structure 16 is not exactly spherical, but is meant and defined herein to indicate a bulkier section which is more rounded at the first end 20. Likewise, the elongated portion is utilized herein to define the somewhat elongated section at the second end 22.

The outdoor chair 10 is provided with a pair of shoulder straps 24 and 26 for ease in carrying or transporting the outdoor chair 10. They are preferably provided at the first end 20 on spherical structure 16. For actual transport, elongated portion 18 is folded in the direction of arrow 28 to be juxtaposed with spherical structure 16 and held in that position by folding strap 30 which is comprised of sections 32 and 34. The outdoor chair is shown in the folded position in FIG. 7.

At least one set of straps is provided for securing other items such as other gear during transport. Preferably, as illustrated in the drawings, three sets of straps 36, 38 and 40 are so provided. The gear and attachment straps 36, 38 and 40 may be utilized to attach the outdoor chair 10 to various supporting structures, such as the truck and limbs of trees. The gear and supporting straps 36, 38 and 40 are each provided with a pair of diverging straps where a Y section of strap provides additional securing ability, that is prevents sliding of gear or the sliding on the limbs. By having a pair of straps instead of a single strap going around the gear or the supporting structure such as a tree limb sliding is prevented, and the pair of straps also provide flexibility in the manner in which the straps are secured to other items such as gear and supporting structures. For example, strap 36 has a pair of Y of attaching straps 42 and 43 on one end and another set of mating attaching straps 44 and 45 on the other end. For example, connector 42 may mate with connector 44 and connector 43 may mate with connector 45. Similarly, strap 38 is provided with a pair of connectors or a Y set of connectors 46 and 47 which may mate with connectors 48 and 49 respectively. Similarly, strap 40 has a pair of Y connectors 50 and 51 which may mate respectively with connectors 52 and 53. The strap ends may be connected as described either for securing additional gear or to secure them to each other and hold them adjacent to the bag for convenience to keep them from dangling. Alternatively, the ends of the Y may be connected together to a supporting structure, for example connectors 42 and 43 may be connected together with the Y portion of the straps encircling a branch of a tree. For example, if the spherical portion 16 is positioned on a pair of forking limbs, connectors 42 and 43 may be connected together around the one limb and connectors 44 and 45 may be connected together around the other forking limb.

Figure 2:
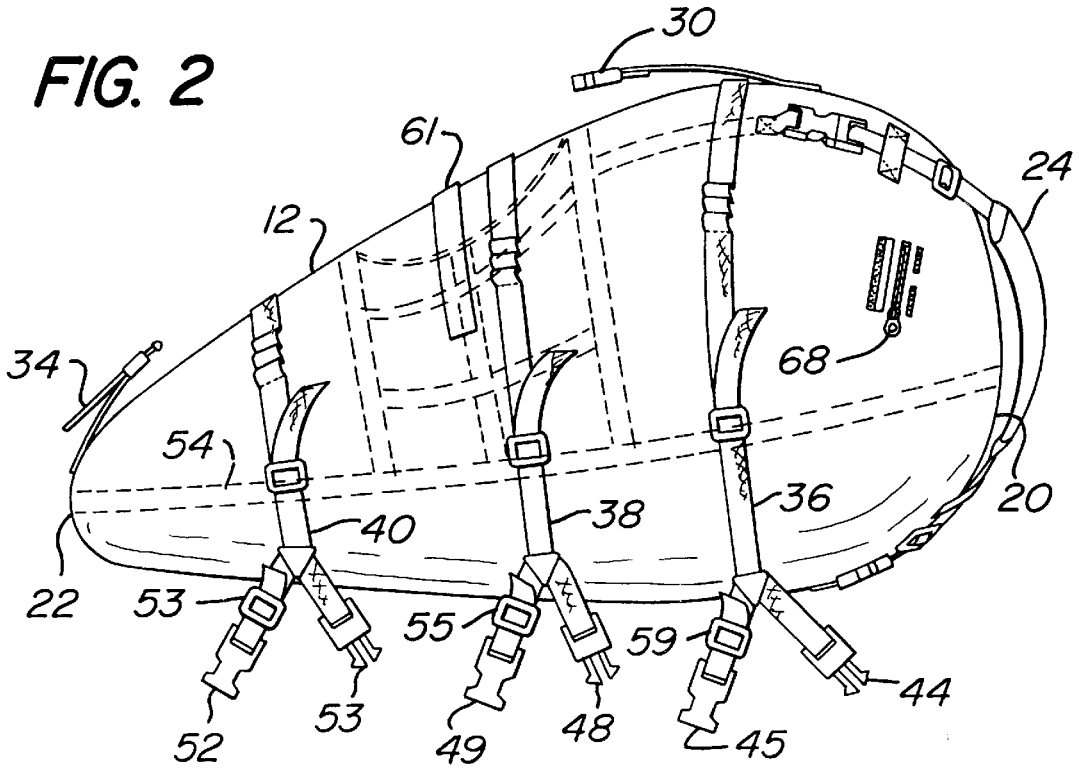
FIG. 2 is an elevation view from the side opposite that shown in FIG. 1 of the portable support for a person for use in an outdoor setting with a plurality of internal supporting members attached to the inner surface of the flexible container being shown in dotted outline form.
Figure 3:
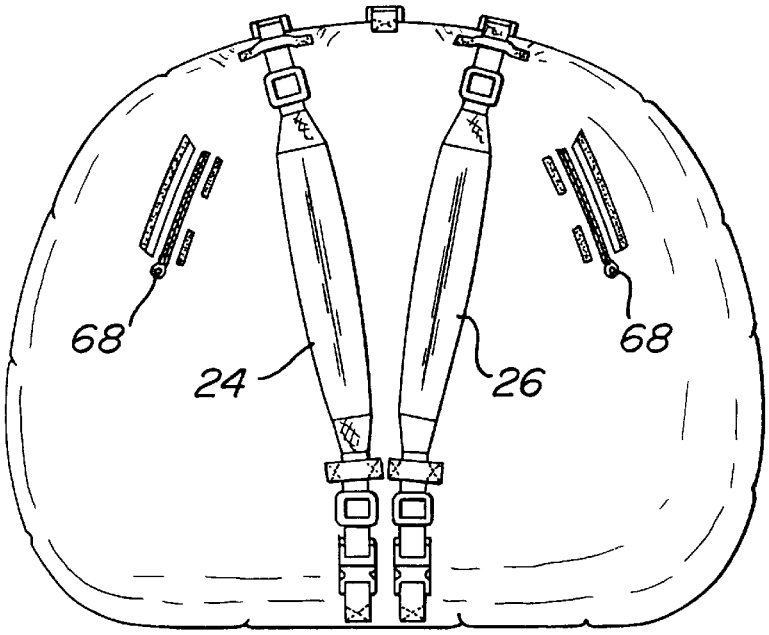
FIG. 3 is an elevation view of the apparatus of FIG. 1 viewed from the left side of FIG. 1.

As may be best seen in FIGS. 2 and 4, flexible container 12 may be provided with internal supporting members 54 secured to the inner surface of the flexible container 12 for reinforcing the flexible container during use. These may be strips of canvas, nylon or other suitable material which are preferably adhesively secured to the inner surface of flexible container 12. However, they may be secured to the inner surface of flexible container 12 by any suitable means including sewing. However, in view of the fact that the flexible container is preferably waterproof, if the internal supporting members 54 are sewn to the flexible container 12, it is preferred that the stitching be covered with a waterproofing agent.

The outdoor chair 10 is also provided with a sealable pocket 56 as may be best seen in FIGS. 1, 2 and 5. Sealable pocket 56 is sewn or adhesively secured within flexible container 12 as illustrated in FIG. 5. Preferably, sealable pocket 56 has a readily openable and sealable opening such as a zipper structure, which may preferably be a waterproof zipper structure 58. This zipper structure 58 is preferably provided with a cover 61, best illustrated in FIGS. 1 and 2, for helping to insure a waterproof seal. The cover 61 may be secured over zipper 58 by means of a hook and loop cloth fastener commercially available under the trademark VELCRO.

Figure 6:
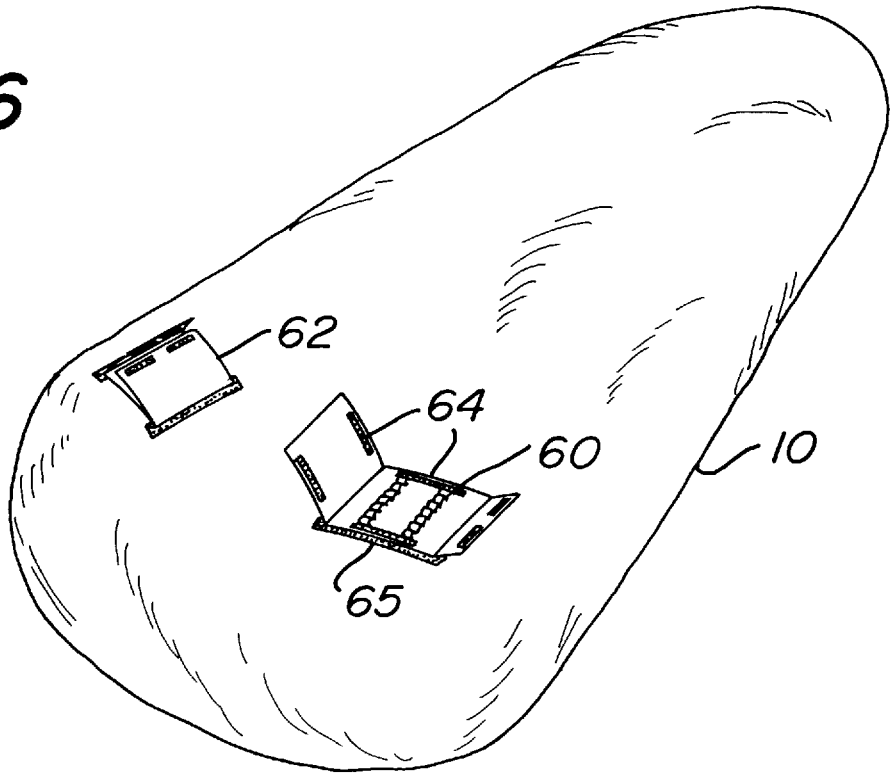
FIG. 6 is a view in perspective of the apparatus of FIG. 1 without straps, but illustrating sealable packets mounted thereon.

As illustrated in FIG. 6, sealable packets 60 and 62 may be secured to the outer surface of flexible container 12 to provide ready access to various items, such as ammunition, sunglasses, cigarettes or other items. These may be provided with VELCRO type hook and loop cloth fasteners as illustrated in 64. The sealable packets themselves may be releasably or removably mounted to outdoor chair 10 by means of VELCRO type hook and loop cloth fastener 65.

The outdoorsman's chair 10 may be provided with footstraps 66 which provide comfort during seating for extended periods of time. The footstrap 66 may be retained within a sealable pocket 68 when not in use as illustrated in FIG. 1.

The outer surface of flexible container 12 may be provided with a variety of different colors which are best suited for use as camouflage in a particular location wherein the outdoorsman's support or chair is to be used, such as white in a snow covered location or washed out brown and green in a forest location. The surface of flexible container 12 may be a single color or it may be multiple colors. When used in connection with hunting, an alternative to selecting colors which may be utilized as camouflage, a bright orange color may be selected for safety, that is to prevent other hunters from shooting in the direction of the person utilizing the outdoorsman's support or chair.

Figure 7:
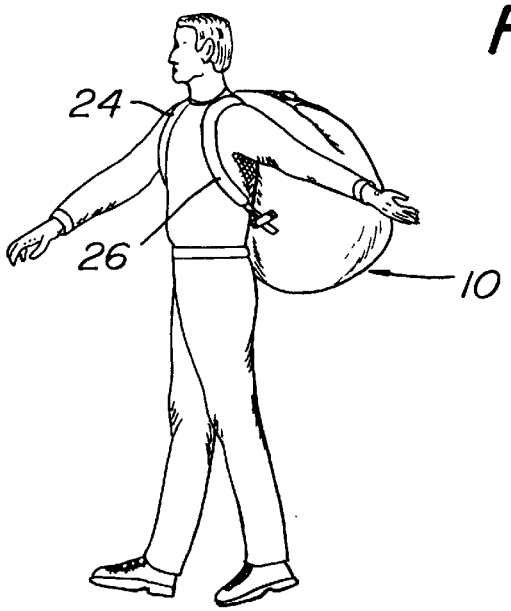
FIG. 7 is an elevation view of the apparatus of FIG. 1 shown in the folded position and mounted on the shoulders of a person for transport, without the detail of all of the straps.

Referring to FIG. 7, the outdoorsman's support or chair 10 is shown as being transported by use of the shoulder straps 24 and 26.

Figure 8:
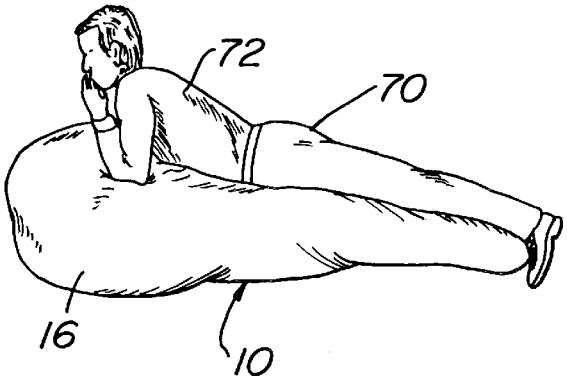
FIG. 8 is an elevation view of the apparatus of FIG. 1 illustrated as being utilized by a person in a prone position, again without the detail of all of the straps.

In FIG. 8, the outdoorsman's support or chair 10 is shown as being used to support a person 70 in a prone position wherein the upper torso 72 is juxtaposed the spherical structure 16 of the outdoorsman's support 10. The outdoorsman's support or chair when used as illustrated in FIG. 8 may also be used to support a rifle or other gun providing a steadying effect and improving the accuracy of any shot. The outdoorsman's support or chair may also be utilized as a gun support in the other applications or shapes illustrated, but the configuration utilized for the prone position as illustrated in FIG. 8 is particularly adaptable for use as a gun support.

Figure 9:
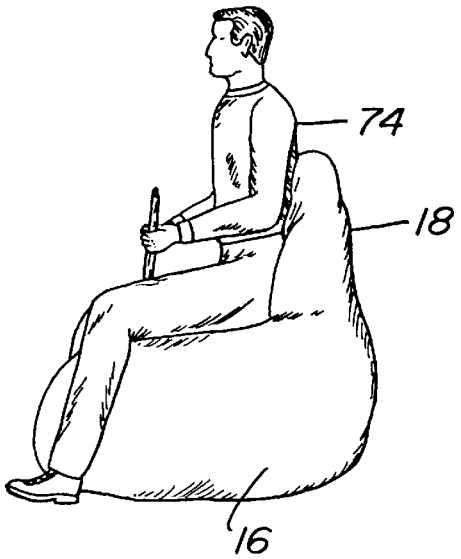
FIG. 9 is an elevation view of the apparatus of FIG. 1 illustrating use as a chair with a back support, again without all of the detail of all of the straps.

In FIG. 9, a person 74 is illustrated to be utilizing the outdoorsman's support and chair wherein the spherical portion 16 is utilized as the seating support with the elongated portion 18 being used as a back support.

Figure 10:
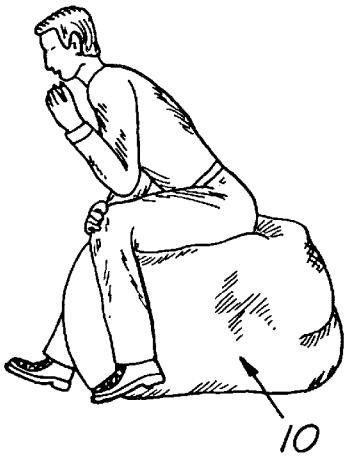
FIG. 10 is an elevation view of the apparatus of FIG. 1 utilized for supporting a person in a seated position without a back rest, again without the detail of all of the straps.

In FIG. 10, the outdoorsman's support or chair 10 is shown as being utilized as a seating support without a back support.

With respect to use of the straps in mounting the Outdoorsman's Chair in a tree wherein the elongated portion 18 acts as a back rest against the trunk of a tree and the spherical structure 16 acts as a seat, the seat 16 may be placed on a pair of limbs projecting outwardly at angles from the trunk and the elongated portion 18 may be mounted against the tree trunk. In such a case, strap 40 may be utilized in connection with buckles 50 and 51 and 52 and 53 to mount elongated portion 18 to the tree truck. Straps 36 and/or 36 and 38 may be utilized to mount to the branches. For example, buckles 42 and 43 may be connected together around one of the branches and buckles 44 and 45 may be mounted around another branch. Straps may be used in various alternative ways to mount to trees or other supports. Of course, in various mounting applications, the female portion of the Y strap may be elongated utilizing strap length adjustment buckles 37, 39 and 41 as shown in FIG. 1 and/or buckles 53, 55 and 59 as shown in FIG. 2.

The present invention may be embodied in other specific forms without departing from the spirit or essential attributes thereof and, accordingly, reference should be made to the appended claims, rather than to the foregoing specification as indicating the scope of the invention.

We claim:

1. A portable support for a person for use in an outdoor setting, comprising:

a flexible container, said flexible container being at least partially filled with discrete particles, said flexible container being adapted to conform to a shape adapted to support a person in seated and other positions;

straps attached to said flexible container, said straps being adapted for mounting over a person's shoulders;

wherein said flexible container is shaped as a substantially spherical structure at a first end and an elongated portion at a second end;

including a folding strap wherein said elongated portion may be folded and juxtaposed to said spherical structure and secured by said folding strap.

2. An apparatus in accordance with claim 1 including a sealable pocket mounted within said flexible container.

3. An apparatus in accordance with claim 1 including a second pair of straps adapted to be releasably connected together for mounting an additional object to said flexible container when being transported by a person and for securing said flexible container in position when utilized to support a person.

4. An apparatus in accordance with claim 3 including a third and fourth pair of straps for securing items to said flexible container and for securing said flexible container when in use to support a person.

5. An apparatus in accordance with claim 1 including a plurality of supporting members secured to the inner surface of said flexible container for reinforcing said flexible container during use.

6. An apparatus in accordance with claim 1 including a pair of foot straps mounted to said flexible container.

7. An apparatus in accordance with claim 1 including a pair of foot straps mounted to said spherical structure of said flexible container.

8. An apparatus in accordance with claim 1 wherein said flexible container has mounted thereon a sealable packet for holding incidentals.

9. An apparatus in accordance with claim 8 wherein said sealable packet is releasably mounted to said flexible container and wherein said incidentals comprise ammunition.

10. An apparatus in accordance with claim 1 wherein said apparatus may be utilized with said spherical structure at said first end providing a seating support and said elongated portion providing a back support.

11. An apparatus in accordance with claim 1 wherein said apparatus may be utilized to provide support in a prone or supine position wherein the upper torso of a person may be juxtaposed with said spherical structure.

12. An apparatus in accordance with claim 1 wherein said flexible container is waterproof.

13. An apparatus in accordance with claim 1 wherein said particles are comprised of polystyrene pellets.

14. An apparatus in accordance with claim 1 wherein an outer surface of said flexible container is provided with a plurality of colors selected to provide a camouflage effect.

15. A portable support for a person for use in an outdoor setting, comprising:

a flexible container, said flexible container being at least partially filled with particles, said flexible container being adapted to conform to a shape adapted to support a person in seated and other positions;

straps attached to said flexible container, said straps being adapted for mounting over a person's shoulders;

including a second pair of straps adapted to be releasably connected together for mounting an additional object to said flexible container when being transported by a person and for securing said flexible container in position when utilized to support a person;

including a third and fourth pair of straps for securing items to said flexible container and for securing said flexible container when in use to support a person; and wherein said second, third and fourth pair of straps have a first and a second terminating strap in the form of a Y, said first strap including a female connector and said second terminating strap including a male connector.

16. An apparatus in accordance with claim 15 wherein at least one of said first and second terminating straps is provided with a strap length adjustment buckle.

* * * * *